US007376378B2

(12) United States Patent
Van Bortel

(10) Patent No.: US 7,376,378 B2
(45) Date of Patent: May 20, 2008

(54) METHOD AND SYSTEM FOR IMPROVED METERING OF RELEASE AGENT IN AN ELECTROPHOTOGRAPHIC SYSTEM

(75) Inventor: David P. Van Bortel, Victor, NY (US)

(73) Assignee: Xerox Corporation, Norwalk, CT (US)

( * ) Notice: Subject to any disclaimer, the term of this patent is extended or adjusted under 35 U.S.C. 154(b) by 20 days.

(21) Appl. No.: 11/114,412

(22) Filed: Apr. 25, 2005

(65) Prior Publication Data

US 2006/0239728 A1 Oct. 26, 2006

(51) Int. Cl.
*G03G 15/20* (2006.01)

(52) U.S. Cl. ..... 399/325

(58) Field of Classification Search ..... 399/325
See application file for complete search history.

(56) References Cited

U.S. PATENT DOCUMENTS

| | | | | |
|---|---|---|---|---|
| 4,214,549 | A | 7/1980 | Moser | |
| 5,426,495 | A * | 6/1995 | Sawamura et al. | 399/331 |
| 5,697,036 | A * | 12/1997 | Moser | 399/329 |
| 5,984,848 | A * | 11/1999 | Hyllberg et al. | 492/46 |
| 6,091,924 | A | 7/2000 | Bhattacharya | |
| 6,112,045 | A | 8/2000 | Hauman | |
| 6,272,307 | B1 * | 8/2001 | Ishizuka et al. | 399/325 |
| 6,351,619 | B1 | 2/2002 | Yamada | |
| 6,408,159 | B2 | 6/2002 | Ishizuka et al. | |
| 6,445,902 | B1 | 9/2002 | Hirst et al. | |
| 6,449,456 | B1 | 9/2002 | Cahill et al. | |
| 6,557,838 | B2 | 6/2003 | Fujita et al. | |
| 6,580,895 | B2 | 6/2003 | Hirst et al. | |
| 2002/0141795 | A1 | 10/2002 | Hirst et al. | |
| 2003/0221585 | A1 * | 12/2003 | Larson et al. | 106/2 |

FOREIGN PATENT DOCUMENTS

| | | | |
|---|---|---|---|
| JP | 55060179 | A * | 5/1980 |
| JP | 58022890 | A * | 2/1983 |
| JP | 62252894 | A * | 11/1987 |
| JP | 04273276 | A * | 9/1992 |
| JP | 08063029 | A * | 3/1996 |
| JP | 11282294 | A * | 10/1999 |

* cited by examiner

*Primary Examiner*—David M Gray
*Assistant Examiner*—Erika J. Villaluna
(74) *Attorney, Agent, or Firm*—Maginot, Moore & Beck

(57) ABSTRACT

An improved release agent management subsystem for an electrophotographic system comprises a release agent reservoir for storing release agent, and a metering roll at least partially submerged in the release agent stored in the release agent reservoir, the metering roll for delivering release agent from the release agent reservoir to a fusing station. The metering roll includes a metallic cylinder having sealed ends, and an inductive heater located proximate the metering roll for inductively heating the metering roll so heat is transferred from the metering to the release agent being delivered by the metering roll to the fusing station.

17 Claims, 2 Drawing Sheets

METHOD AND SYSTEM FOR IMPROVED METERING OF RELEASE AGENT IN AN ELECTROPHOTOGRAPHIC SYSTEM

TECHNICAL FIELD

The present invention relates generally to electrophotographic printing machines, and more particularly, to electrophotgraphic printing machines having release agent management systems.

BACKGROUND

In electrophotographic processes, a light image of an original document is typically recorded in the form of a latent electrostatic image upon a photosensitive member. The latent image is subsequently developed on the photosensitive member by applying electroscopic marking particles, commonly referred to as toner. The visual toner image is then typically transferred from the photosensitive member to another support member, such as a sheet of plain paper. The transferred image is then affixed to the support member typically, for example, by using heat and pressure applied at a fusing station.

In order to affix or fuse electrostatic toner material onto a support member by heat and pressure, the temperature of the toner material is elevated to a point at which the constituents of the toner material coalesce and become tacky while simultaneously applying pressure. This action causes the toner to flow to some extent into the fibers or pores of a support member. Thereafter, as the toner material cools, it solidifies which causes the toner material to be bonded firmly to the support member. In the electrophotographic recording arts, the use of thermal energy and pressure for fixing toner images onto a support member is old and well known.

One approach to heat and pressure fusing of electroscopic toner images onto a support member has been to pass the support member bearing the toner images between a pair of opposed roller members, at least one of which is internally heated. During operation of a fusing system of this type, the support member to which the toner images are electrostatically adhered is moved through the nip formed between the rolls so the toner image contacting the fuser roll is heated within the nip. By controlling the heat transferred to the toner, virtually no offset of the toner particles from the copy sheet to the fuser roll is experienced under normal conditions. As long as the heat applied to the surface of the roller is insufficient to raise the temperature of the surface of the roller above the "hot offset" temperature of the toner, the toner particles in the image areas of the toner do not liquefy and cause a splitting action in the molten toner. This type of splitting is sometimes known as "hot offset." Splitting occurs when the cohesive forces holding the viscous toner mass together are less than the adhesive forces holding toner to a contacting surface, such as a fuser roll.

Occasionally, however, toner particles are offset onto the fuser roll by an insufficient application of heat to the surface of the fuser roll. This phenomenon, sometimes called "cold" offsetting; may be caused by imperfections in the properties of the surface of the roll or by weak electrostatic forces that are used to adhere the toner particles to the copy sheet. In such a case, toner particles may be transferred to the surface of the fuser roll with subsequent transfer to a backup roll in the fusing station during periods of time when no copy paper is in the nip. Toner particles may also be picked up by the fuser roll and/or backup roll during fusing of duplex copies or from the surroundings of the reproducing apparatus.

One arrangement for minimizing the foregoing problems, particularly that which is commonly referred to as "offsetting," has been to provide a Viton fuser roll to which a release agent such as silicone oil is applied. The thickness of the Viton covering on the fuser roll is on the order of several mils and the thickness of the oil is less than 1 micron. Silicone based (polydimethylsiloxane) oils, which possess a relatively low surface energy, have been found to be materials that are suitable for use with heated Viton fuser rolls. In practice, a thin layer of silicone oil is applied to the surface of the heated roll to form an interface between the roll surface and the toner images carried on the support member. Thus, a low surface energy layer is presented to the toner as it passes through the fuser nip and thereby prevents toner from offsetting to the fuser roll surface.

One method for facilitating the release of a support member from the fuser roll is to apply a release agent to the fuser roll to reduce the degree of support member adhesion to the fuser roll to a point where the support member separates from the fuser roll as it leaves the nip at the fuser roll. One release agent material used to facilitate release of a support member is silicone oil. The silicone oil is applied to the fuser roller by a Release Agent Management (RAM) system. The RAM system includes a supply of release agent, a metering roll to transfer the release agent from the supply to the fuser roll. In some RAM systems, a donor roll may also be included to transfer the release agent from the metering roll to the fuser roll.

An example of a RAM system is disclosed in U.S. Pat. No. 4,214,549 issued on Jul. 29, 1980 to Rabin Moser. This patent illustrates a heat and pressure roll fusing apparatus for fixing toner images to copy substrates. The apparatus includes an internally heated, fuser roll cooperating with a backup or pressure roll to form a nip through which the copy substrates pass with the images contacting the heated roll. The pressure roll is the softer of the two rolls, therefore, the nip is formed by the harder fuser roll indenting the softer pressure roll. The heated fuser roll is characterized by an outer layer or surface which by way of example is fabricated from a very thin silicon rubber or Viton material to which a low viscosity polymeric release fluid is applied. Release fluid is contained in a sump from which it is dispensed by means of a metering roll and a donor roll, the former of which contacts the release fluid in the sump and the latter of which contacts the surface of the heated fuser roll. The donor roll is provided with an outer elastomeric layer which is deformable by both the heated fuser roll and the metering roll. Thus, the driven fuser roll imparts rotational movement to the donor roll which, in turn, causes the metering roll to rotate. While a donor roll RAM system provides a microscopic, uniform layer of release agent on a copy, the donor roll also contributes a thermal load on the fuser roll during machine standby as well as during a printing run. Additionally, the release agent may also provide a thermal load on the fuser roll.

To reduce the thermal load imposed by the release agent, RAM systems have been modified to heat the release agent supply so the release agent applied by the metering roll to the donor roll is at a temperature higher than room temperature. In donor roll RAM systems, however, the relatively small amount of release agent may sufficiently cool before being applied to the fuser roll that the thermal load of the donor roll may affect the effectiveness of the fusing station. Other RAM systems have been modified to heat the metering roll. Because the metering roll is interposed between the release agent supply and the donor roll, both components are warmed by the heated metering roll and the thermal load of the donor roll on the fuser roll is reduced.

In RAM systems in which the metering roll is heated, the metering roll is open at one end so a heater may be inserted in the internal volume of the hollow metering roll. The metering roll is cantilevered mounted so the open end remains above the release agent level in the supply and the other end is coupled to a rotational driver. As the system is used, however, the cantilevered metering roll sags and the release agent is able to enter the internal volume of the metering roll. The direct heat of the heater on the release agent in the interior of the metering roll causes the release agent to decompose and form a residue. This residue, in turn, may flow back into the release agent supply and contaminate the release agent in the supply. Additionally, the internal heater is thermally coupled to the surface of the metering roll through convection and the distribution of heat along the metering roll may be very uneven. At start up, thermal gradients of as much as 100° F. between the center of the roll and its ends may be experienced. Furthermore, the cartridge heaters used for the metering roll internal heaters are relatively expensive.

SUMMARY

The above-described limitations of release agent management systems (RAM) in known electrophotographic machines are addressed by a system and method that distributes heat along a sealed metering roll in a RAM. An improved release agent management (RAM) subsystem for an electrophotographic system comprises a release agent reservoir for storing release agent and a heated, sealed metering roll at least partially submerged in the release agent stored in the release agent reservoir. The metering roll for delivering release agent from the release agent reservoir to a fusing station is comprised of a metallic cylinder having sealed ends and an inductive heater located proximate the metering roll for inductively heating the metering roll so heat is transferred from the metering to the release agent being delivered by the metering roll to the fusing station.

A RAM subsystem having a sealed, heated metering roll addresses a number of limitations of previously known RAM subsystems. For one, the sealed ends enable the metering roll to be submerged in the release agent reservoir with reduced risk of release agent entering the metering roll and being decomposed by the heat. For another, in embodiments of the improved RAM subsystem in which the sealed metering roll is heated by an externally located inductive heater, leaks allowing release agent to enter the metering roll are less likely to contaminate the release agent supply because the release agent is not between the heat source and the metering roll cylindrical wall. Instead, the inductive heater only heats the metering roll cylindrical wall and the release agent is heated by convention and conduction heating from the metering roll. Thus, the release agent entering the metering roll through inadvertent leaks is less likely to experience a temperature that causes the release agent to decompose.

A method for providing warm release agent to a fusing station of an electrophotographic system comprises storing release agent in a release agent reservoir; inductively heating a metering roll at least partially submerged in the release agent stored in the release agent reservoir, and transferring release agent warmed by the inductively heated metering roll to a fusing station in an electrophotographic system. The inductive heating of the metering roll is more efficient than the convection heating previously used and the inductive heaters are typically cheaper than the cartridge heaters used to heat cantilevered metering rolls in some RAM subsystems.

The above described features and advantages, as well as others, will become more readily apparent to those of ordinary skill in the art by reference to the following detailed description and accompanying drawings.

BRIEF DESCRIPTION OF THE DRAWINGS

By way of example, an embodiment of the invention will be described with reference to the accompanying drawings, in which.

DETAILED DESCRIPTION

Figure 1:
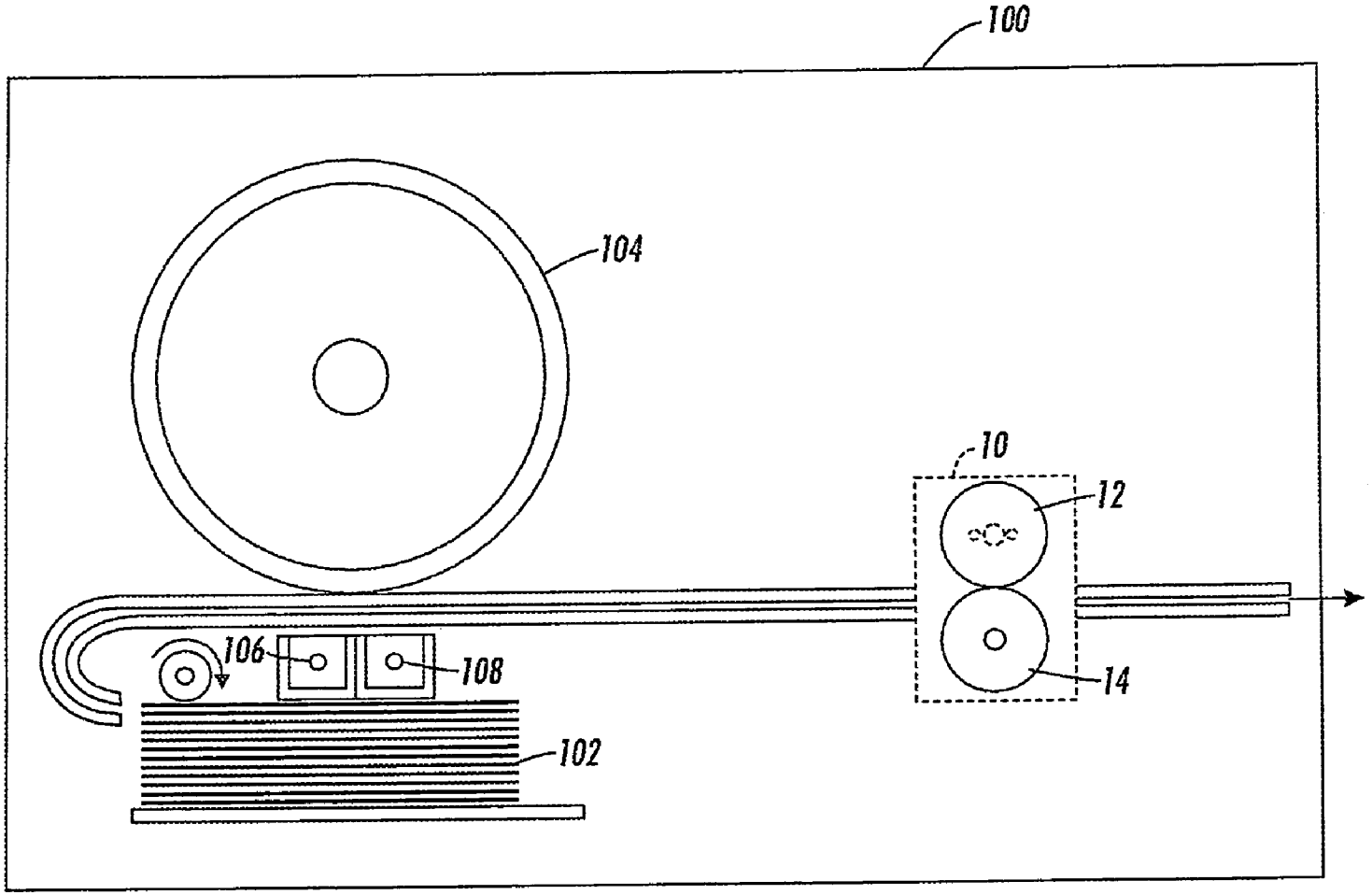
FIG. 1 PRIOR ART
FIG. 1 is a schematic elevational view depicting an illustrative fusing system in an electrophotographic system.

In the drawings, like reference numerals have been used throughout to designate identical elements. FIG. 1 schematically depicts some of the various components of an illustrative electrophotographic printing machine that may include the improved RAM subsystem described herein. This RAM subsystem is also well suited for use in a wide variety of electrostatographic printing machines. Because the various processing stations employed in the FIG. 1 printing machine are well known, they are shown schematically and their operation is described only briefly.

FIG. 1 is a simplified elevational view showing the essential portions of an electrostatographic printer, such as a xerographic printer or copier, that may be used with the improved RAM subsystem described below. A printing apparatus 100, which can be in the form of a digital or analog copier, "laser printer," lonographic printer, or other device, includes mechanisms which draw substrates S, such as sheets of paper, from a stack 102 and cause each sheet to obtain a toner image from the surface of a charge receptor 104. The toner image is transferred from the charge receptor 104 to the sheet at by a transfer corotron 106, and the sheet is detached from the surface of the charge receptor 104 by a detack corotron 108. Once a particular sheet obtains marking material from charge receptor 104, the sheet is caused to pass through a fusing apparatus such as generally indicated as 10. (Although a charge receptor 104, as would be used in an electrostatographic printer, is shown, other types of "marking station," such as including an ink-jet printhead and/or an intermediate transfer member, can be contemplated in conjunction with the claimed invention.) Depending on a particular design of a printing apparatus, fusing apparatus 10 according to the invention may be in the form of a fuser module which can be readily removed and installed, in modular fashion, from the larger apparatus 100.

A typical design of the fusing apparatus 10 includes a fuser roll 12 and a pressure roll 14. Fuser roll 12 and pressure roll 14 cooperate to exert pressure against each other across a nip formed therebetween. When a sheet passes through the nip, the pressure of the fuser roll 12 against the pressure roll 14 contributes to the fusing of the image on a sheet. Fuser roll 12 further includes means for heating the surface of the fuser roll 12, so that heat can be supplied to the sheet in addition to the pressure, further enhancing the fusing process. Typically, the fuser roll 12, having the heating means associated therewith, is the roll which contacts the side of the sheet having the image desired to be fused.

Generally, the most common means for generating the desired heat within the fuser roll 12 is one or more heating elements within the interior of fuser roll 12. The heating elements heat the outer surface of fuser roll 12 so it reaches a desired temperature. Basically, the heating elements can comprise any material which outputs a certain amount of heat in response to the application of electrical power thereto. Such heat-generating materials are well known in the art. In some electrophotographic systems, a release agent management (RAM) subsystem applies release agent to the fuser roll 12 to reduce toner offset on the fuser roll 12 and/or the backup roll 14. RAM subsystems, however, may act as a thermal load on the fuser roll 12 and affect the fusing of the toner image on the substrate S.

Figure 2:
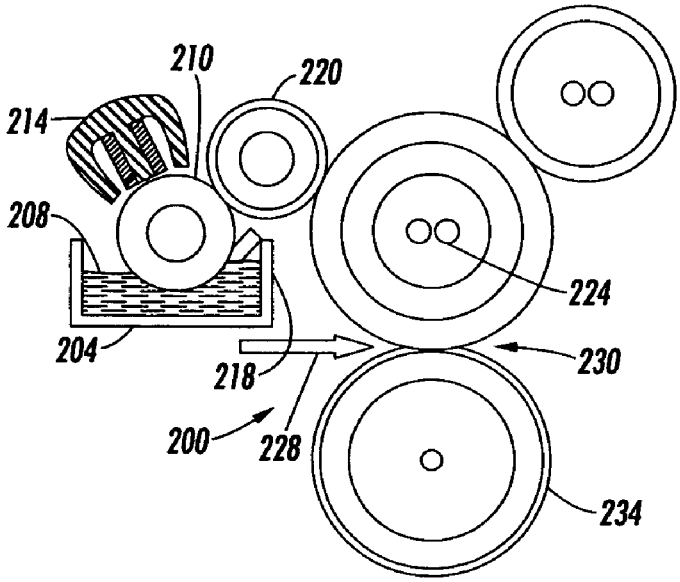
FIG. 2 is a side elevational schematic view of an improved release agent management (RAM) subsystem used in the electrophotographic system of FIG. 1.

One embodiment of an improved RAM subsystem that reduces the risk of the RAM subsystem acting as a thermal load on the fuser roll 12 is shown in FIG. 2. The subsystem 200 includes a sump 204 that contains a supply of release agent 208. A sealed metering roll 210 is partially submerged in the release agent in sump 204. An inductive heater 214 is located proximate the metering roll 210 to inductively heat the metering roll 210. A metering blade 218 is positioned to even the layer of the release agent on the metering roll 210 as it rotates out of the sump 204. Release agent is transferred from the metering roll 210 to donor roll 220, which, in turn, transfers the release agent to the fuser roll 224. The support member 228, to which toner layers have been applied, passes through the nip 230 that is formed between the fuser roll 224 and the backup roll 234 to fix the toner image to the support member 228. The inductive heating of the metering roll 210, the conductive heating of the transferred release agent by the metering roll 210, and the internally heated fuser roll 224, reduce the likelihood that the release agent and the donor roll 220 impose an unacceptable thermal load to the heated fuser roll 224.

Figure 3:
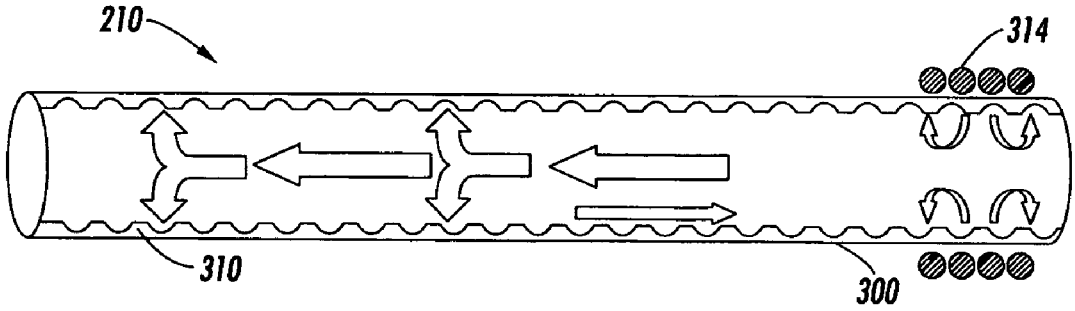
FIG. 3 is a side elevational view of a metering roll that may be used in the RAM subsystem of FIG. 2.

Metering roll 210, one embodiment of which is shown in FIG. 3, may be a metallic cylinder 300 having sealed ends that is, preferably, a hollow steel cylinder. Metals, such as steel, more easily form the eddy currents that heat the metering roll 210 in response to the changing electromagnetic fields emitted by the inductive heater 214. A steel metering roll may also include a chrome plating to improve the wear life of the metering roll 210. The metering roll 210 may also be constructed of a ferromagnetic alloy or the plating for a steel tube may be a ferromagnetic alloy that has a high saturation flux. Materials with high saturation flux permit the formation of eddy currents sufficiently intense to generate significant amounts of heat. Nickel is one such ferromagnetic material, although others may be used. The material should be sufficiently thick to provide adequate thermal storage capacity, but thin enough to enable the metering roll to be heated quickly. An appropriate thickness for nickel plating is approximately 80 to 100 microns and an effective thickness for a ferromagnetic tube is approximately 3 millimeters.

The metering roll 210 may also be constructed in a heat pipe configuration. A heat pipe configuration may be comprised of two cylinders concentrically mounted with respect to one another, but the diameter of one cylinder is less than the other cylinder so a gap or passageway is formed between the outside longitudinal surface of one cylinder and the inner longitudinal surface of the other cylinder. Because the ends of the inner tube are abut the end walls of the outer tube, the passageway forms a generally cylindrical volume between the two tubes. A heat conductive liquid, such as water or ethylene glycol, may be inserted in the cylindrical volume and the air evacuated to form a vacuum in this interior volume. The evacuation port is sealed to maintain the vacuum. An alternative construction of the heat pipe may be a single walled cylinder with closed ends. When the metering roll 210 is heated by the inductive heater 214, the liquid proximate the portion of the tube heated by the inductive heater is vaporized. The rotation of the metering roll 210 and temperature differential between the vapor and the liquid causes the vapor to migrate away from the heated area and the liquid to move towards the heated area. Wicking material may be placed in the internal volume of the passageway to promote the movement of the vapor and liquid in the volume. The movement of the liquid and vapor distributes heat along the length of the metering roll 210 more uniformly. The passageway may also be formed by etching or cutting helical or serpentine grooves 310 in a metal tube, as shown in FIG. 3, and then plating the tube while covering the grooves so the plating does not fill the grooves.

The inductive heater 214 may be internally within the metering roll 210 or proximately to the surface of the metering roll, as shown in FIG. 2. If the inductive heater 214 is internally mounted, an opening is required so the conductors bringing the high frequency current to the heater may be coupled to a power source. If the inductive heater is externally mounted, the inductive heater is placed closely to the surface of the metering roll 210. The electromagnetic material of an externally positioned inductive heater may be shaped in an open-ended structure, as shown, for example, in FIG. 2, or it may be a toroid 314 that is mounted concentrically about the metering roll, as shown, for example, in FIG. 3. The ends of the inductive heater 214 may be located approximately 1-2 mm from the external surface of the metering roll 210, for example, and the ends of the heater may be curved to follow the curvature of the roll.

The inductive heater 214 may be a ferrite core or other magnetic material around which an insulated conductor is wound. An alternating current is coupled to the conductor to causes the magnetic material to emit changing electromagnetic fields. A high frequency current of approximately 10 KHz to 100 KHz may be delivered to the coil or other electromagnetic structure used to implement the inductive heater 214. A thermistor or other thermocouple may be mounted internally or proximate the metering roll 210 to provide a signal indicative of the temperature of the metering roll. This signal may be provided to a power controller to determine when the high frequency current should be coupled to the inductive heater.

The heat pipe configuration of the metering roll may be used with an internal heater, such as a cartridge heater or a halogen wire heater. While this type of heater is relatively more expensive than an inductive heater, the heat pipe configuration improves the distribution of the heat for the metering roll over previously known heated metering rolls. Likewise, the inductive heating of the metering roll used alone provides more economical heating of the metering roll and is more effective for heating the metering roll than heaters relying on conduction for the heat coupling mechanism. The combination of the heat pipe configuration with the inductive heater provides a metering roll that is more quickly heated and that more uniformly heats the metering roll. The heated metering roll and the warmed release agent are especially thought effective for reducing the likelihood that the donor roll becomes a heat sink to the fuser roll in a fusing station.

The RAM subsystem described above may be operated to more effectively provide release agent to a fuser roll in a fusing station of an electrophotographic system. The RAM subsystem is operated to inductively heat a metering roll partially submerged in a release agent sump and the metering roll is rotated to transfer release agent warmed by the heated metering roll from the release agent sump to a donor roll. Liquid is heated by the metering roll and longitudinally moved along the metering roll to uniformly distribute heat along the metering roll. The heated liquid evaporates in the vicinity of the inductive heating to form a vapor that migrates away from that vicinity and be displaced by cooler liquid. This method of operating an electrophotographic system helps to prevent the conditions for toner offset on the fuser roll.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. An improved release agent management (RAM) subsystem for an electrophotographic system comprising:
- a release agent reservoir for storing release agent;
- a metering roll at least partially submerged in the release agent stored in the release agent reservoir, the metering roll for delivering release agent from the release agent reservoir to a fusing station, the metering roll including:
  - a metallic cylinder having sealed ends;
  - an inductive heater located proximate one of the sealed ends of the metallic cylinder of the metering roll for inductively heating the metallic cylinder of the metering roll to transfer heat from the metallic cylinder of the metering roll to a layer of release agent on the metering roll as it rotates out of the release agent reservoir; and
  - a sealed passageway being provided near a surface of the metering roll, the sealed passageway containing a liquid, the liquid being heated by the metallic cylinder at the sealed end of the metering roll proximate the inductive heater and the heated liquid migrating along the length of the sealed passageway to distribute heat along the metering roll.

2. The RAM subsystem of claim 1, the inductive heater being mounted to an external surface of the metering roll.

3. The RAM subsystem of claim 1 wherein the liquid evaporates at the sealed end proximate the inductive heater and condenses near the sealed end of the metering roll end that is distal from the inductive heater.

4. The RAM subsystem of claim 3, the sealed passageway further including:
- a return passageway for the condensed liquid to return to the sealed end of the metering roll proximate the inductive heater.

5. The RAM subsystem of claim 1 further comprising:
- a donor roll interposed between the metering roll and a fuser roll of the fusing station, the donor roll receiving heated release agent from the metering roll and the donor roll delivering heated release agent to the fuser roll of the fusing station.

6. The RAM subsystem of claim 1, the metering roll being comprised of:
- a steel cylindrical core; and
- a chrome plating forming an external surface over the steel cylindrical core.

7. A method for providing heated release agent to a fuser roll in a fusing station of an electrophotographic system comprising:
- storing release agent in a release agent reservoir;
- inductively heating one end of a metering roll having sealed ends, the metering roll being at least partially submerged in the release agent stored in the release agent reservoir;
- conductively heating a liquid within the metering roll with the heated end of the metering roll;
- transferring the conductively heated liquid from the heated end of the metering roll to an end of the metering roll that is distal from the inductively heated end to distribute heat along the metering roll from the heated end of the metering roll to the distal end of the metering roll; and
- rotating the metering roll partially submerged in the release agent to transfer heat from the inductively heated metering roll to a layer of release agent on the metering roll for delivery to a fuser roll in a fusing station in an electrophotographic system.

8. The method of claim 7, the inductive heating of the metering roll including:
- energizing an inductive heater that is mounted to an external surface of the metering roll.

9. The method of claim 7, the conductive heating of the liquid further comprises:
- evaporating the liquid at the heated end of the metering roll; and
- condensing the liquid near the distal end of the metering roll.

10. The method of claim 9 further including:
- returning the condensed liquid to the end of the metering roll being inductively heated.

11. The method of claim 7 further comprising:
- transferring heated release agent from the heated metering roll to the fuser roll with a donor roll interposed between the inductively heated metering roll and the fuser roll.

12. The method of claim 7, the metering roll being comprised of:
- a steel cylindrical core; and
- a chrome plating forming an external surface over the steel cylindrical core.

13. An electrophotographic machine comprising:
- a photoreceptor onto which a latent image is generated and then developed;
- a fusing station having a fuser roll and backup roll for affixing the developed latent image from the photoreceptor to a support member;
- a release agent management system comprising:
  - a release agent reservoir for storing release agent;
  - a metering roll at least partially submerged in the release agent stored in the release agent reservoir, the metering roll for delivering release agent from the release agent reservoir to the fuser roll of the fusing station, the metering roll including a sealed passageway having a helical groove near a surface of the metering roll and a liquid in the sealed passageway; and
  - an inductive heater proximate the metering roll to inductively heat the metering roll, heat from the inductively heated metering roll being transferred to a layer of release agent on the metering roll and to the liquid in the sealed passageway.

14. The electrophotographic system of claim 13 further comprising:

a donor roll interposed between the metering roll and the fuser roll of the fusing station, the donor roll transferring to the fuser roll heated release agent received from the metering roll.

15. The electrophotographic system of claim 13 wherein the liquid evaporates at one end of the metering roll that is proximate the inductive heater and condenses near an end of the metering roll that is distal from the inductive heater, and the sealed passageway further includes:

a return passageway for the condensed liquid to return to the metering roll end proximate the inductive heater.

16. The electrophotographic system of claim 13, the helical groove being one of an etched groove and a cut groove in the metering roll.

17. The electrophotographic system of claim 13, the helical groove being a plated groove.

* * * * *